United States Patent [19]

Roche et al.

[11] 4,358,701

[45] Nov. 9, 1982

[54] DISCHARGE LAMPS HAVING INTERNAL STARTING AID CAPACITIVELY COUPLED TO ONE OF THE ELECTRODES

[75] Inventors: William J. Roche, Merrimac; John W. Anderson, Jr., Ipswich, both of Mass.

[73] Assignee: GTE Products Corporation, Stamford, Conn.

[21] Appl. No.: 214,371

[22] Filed: Dec. 8, 1980

[51] Int. Cl.[3] ..... H01J 17/00

[52] U.S. Cl. ..... 313/197; 313/220; 313/318; 313/493; 315/DIG. 1

[58] Field of Search ..... 313/197, 493, 220, 318; 315/DIG. 1

[56] References Cited

U.S. PATENT DOCUMENTS

| | | | |
|---|---|---|---|
| 2,277,697 | 3/1942 | Grier | 315/DIG. 1 |
| 2,322,421 | 6/1943 | Cox | 313/318 |
| 2,556,059 | 6/1951 | Braunsdorff | 313/318 |
| 2,733,368 | 1/1956 | Kolkman | 313/492 |
| 2,748,309 | 5/1956 | Hurx | 313/197 |
| 2,829,295 | 4/1958 | Gast et al. | 313/197 |
| 3,194,997 | 7/1965 | Waly | 313/493 |

*Primary Examiner*—Harold A. Dixon

*Attorney, Agent, or Firm*—William H. McNeill

[57] ABSTRACT

A fluorescent lamp assembly is comprised of a lamp and a ballast therefor. The lamp includes an internal, solid wire starting aid connected to third lead-in wire sealed in an end of the lamp. A resistive ballast serially couples the lamp electrodes to a lamp starting means such as a glow-bottle. The starting aid is capacitively coupled to a lead-in wire of its adjacent electrode.

3 Claims, 5 Drawing Figures

DISCHARGE LAMPS HAVING INTERNAL STARTING AID CAPACITIVELY COUPLED TO ONE OF THE ELECTRODES

CROSS-REFERENCES TO RELATED APPLICATIONS

This application discloses, but does not claim inventions which are claimed in U.S. Patent applications Ser. Nos. 214,370; 214,372; and 214,373 filed concurrently herewith and assigned to the assignee of this application.

TECHNICAL FIELD

This invention relates to discharge lamps employing an internal solid wire starting aid. The lamp is used with a resistive ballast which serially couples the lamp electrodes and lamp starting means. Means are provided which capacitively couple the internal starting aid to its adjacent electrode.

BACKGROUND ART

Starting aids for discharge lamps can be characterized by two generic classes, viz: active devices such as pulse generators of one form or another; and passive techniques such as ground planes or probes.

Active devices have the disadvantage of being costly; further, they contribute to the size and weight of the ballast package. The active devices also tend to be complex with this complexity adding a negating factor since the reliability is adversely affected.

Passive starting aids also can be broken down into two distinct classes. First, there is the external type which comprises ground planes adjacent to or in contact with the exterior bulb wall. Examples of this type of starting aid include external conductive bulb wall coatings or stripes and grounded fixtures. The second class of passive starting aids includes internal conductive stripes or coatings and starting probes.

The relative merits of a particular type of passive starting aid depends on the lamp type and the intended market application. For example, the standard F40WT12 lamp relies generally on a grounded fixture to provide the necessary starting function. Energy saving, krypton-filled, F34WT12 lamps rely on an internal conductive film applied between the glass and the phosphor. External stripes and coatings have found favor in Europe.

However, while the use of starting aids has been recognized as a desirable feature, it has not been heretofore possible to provide lamps with an effective and economical internal starting aid utilizing a simple and inexpensive ballast.

SUMMARY OF THE INVENTION

Accordingly, it is an object of the invention to obviate the disadvantages of the prior art.

It is another object of the invention to provide a simple and economical starting aid.

Yet another object of the invention is the provision of a starting aid suited to use with non-linear lamps.

These objects are accomplished, in one aspect of the invention, by the provision of a fluorescent lamp assembly comprised of a lamp and a ballast therefor. The lamp comprises a tubular glass body with electrodes at each end thereof, each electrode being supported by a pair of lead-in wires sealed in glass sealing means. A layer of phosphor coats the interior surface of the lamp body, said body also containing an arc generating and sustaining medium.

One of the ends of the lamp is provided with a third lead-in wire adjacent one of the electrodes. The interior end of this third lead-in wire has a solid wire starting aid connected thereto and extending the length of the lamp body to a position adjacent the other electrode. A resistive ballast completes the assembly. The resistive ballast serially couples the lamp electrodes and a lamp starting means; and means capacitively couple the third lead-in wire (and thus the starting aid) to one of the lead-in wires of its adjacent electrode.

This assembly provides a simple and inexpensive light source.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
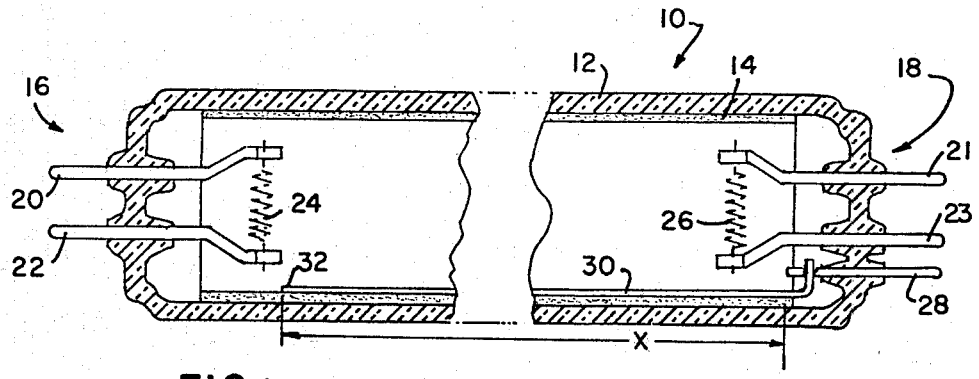
FIG. 1 is sectional view of a lamp employing an internal wire starting aid.

Referring now to the drawings with greater particularity, there is shown in FIG. 1 a discharge lamp 10 comprising a tubular glass envelope 12 having a layer of phosphor 14 on the interior surface thereof. Sealing closure means 16 and 18 close the ends of the envelope 12. An arc generating and sustaining medium which includes mercury fills the sealed envelope 12 which can have been evacuated and filled by any known technique.

The sealing closure means 16 and 18 have lead-in wires 20 and 22 and 21 and 23, respectively, sealed therein and have electrodes 24 and 26 electrically connected thereto and supported thereby. Conventionally, one or both of the sealing closure means is provided with an exhaust tubulation which is not shown in the instant drawings.

One of the sealing closure means, e.g., 18, has a third lead-in wire 28 sealed therein and extending internally and externally of envelope 12. A wire starting aid 30 is electrically connected to the internal end of lead-in 28 and has the major portion of its length contiguous with the phosphor coating 14. Starting aid 30 has a length "x" which is substantially equal to the arc length of lamp 10. Preferably, the aid 30 has its free end 32 terminate adjacent the opposite electrode, in this case, electrode 24. The starting aid 30 is constructed from a material which is substantially inert with respect to the mercury environment of the lamp, such as, e.g., nickel or nickel-plated steel.

Figure 2:
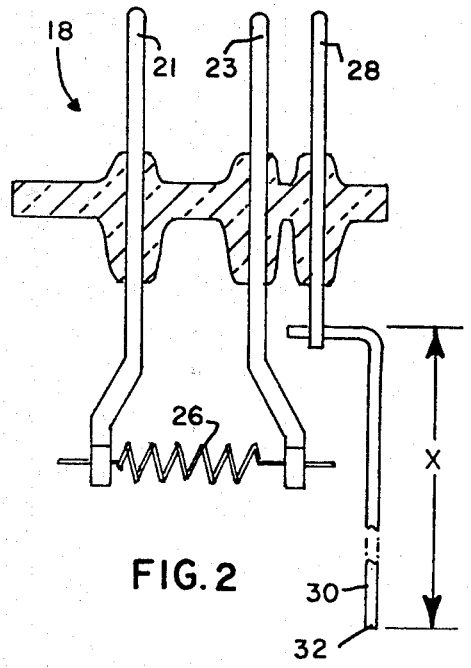
FIGS. 2 and 3 are sectional views of alternate mount structures.
Figure 3:
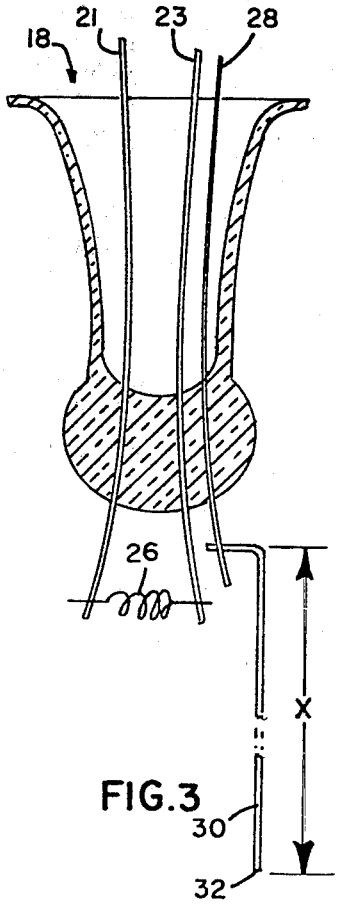

The sealing closure means 16 and 18, which preferably are identical except for the third lead-in wire 28, can be of any desired form. In FIG. 2 is illustrated a sealing closure means 18 having a circular, disc-like format while FIG. 3 illustrates a conventional flare and press configuration. In either case, the means 18 contain the lead-in wires 21 and 23 which support the electrode 26 and the lead-in wire 28 which connects and supports the wire starting aid 30.

Figure 4:
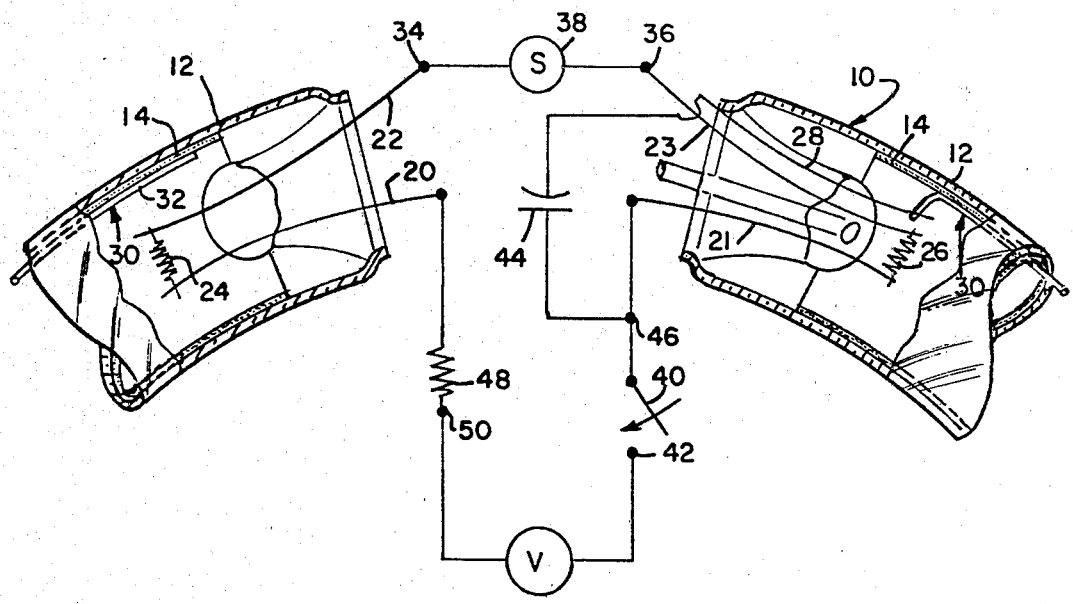
FIG. 4 is a diagrammatic view of a non-linear lamp employing the invention together with the circuitry therefor.
Figure 5:
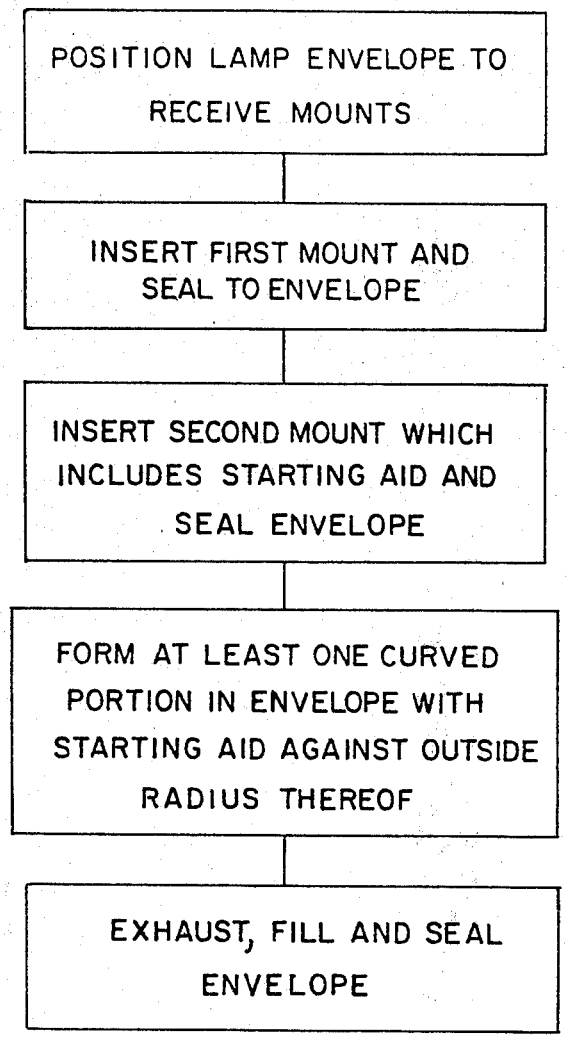
FIG. 5 is a flow diagram of the method of making a lamp.

The wire starting aid 30 has additional advantages when employed in non-linear lamps such as the circular configuration shown partially in FIG. 4. Herein, the lamp 10 is formed so that the wire starting aid 30 lies along the outside diameter of the envelope 12 when it is held in place by the tension imparted thereto by the rolling process.

Lamps 10 are constructed by positioning envelope 12, having phosphor coating 14 on the interior surface thereof, in a manner to receive the sealing closure means or mounts. If the overall length of lamp 10 is small; i.e., 12 inches or less, the envelope 12 may be positioned horizontally; however, the preferred orientation is vertical, particularly for larger sizes.

With the envelope 12 vertically arrayed, mount 16 is inserted into the lower end of the envelope and sealed therein. Mount 18, having the long, wire starting aid attached thereto, is then inserted into the upper end of envelope 12 and sealed thereto. If the final lamp is to remain a linear type, final processing such as exhausting and filling can now be consummated. If the lamp is to be a non-linear type, e.g., circular, the curved portions are formed by conventional techniques; however, the lamp orientation through the forming process must insure that the wire starting aid 30 lies against the outside radius. After forming, the non-linear lamp is exhausted and filled by conventional techniques.

For operation, this lamp is particularly suited to applications where no starting aid is provided by the ballast, such as the resistive ballast shown in FIG. 4. Herein, a supply voltage V, which is preferably 120 V A.C., $60H_z$, is applied to the terminals 34 and 36 of starter 38, which is a conventional glo-starter operating in conventional fashion, when switch 40 is closed. When the starter 38 is conducting, the lamp electrodes 24 and 26 will reach thermionic emission temperature and a substantial space charge will surround them. When the starter 38 opens the preheat circuit and when the instantaneous polarity of the supply voltage is positive at node 42, capacitor 44 will charge positive at node 46. The charging path comprises the wire starting aid 30, the ballast resistor 48, and the supply voltage V. Starting aid 30 is coupled to the electrode 24 by the electron space charge developed during the preheat phase. The voltage developed across capacitor 44 will depend upon the value of the capacitor, the space charge at electrode 24, and the proximity of electrode 24 to the starting aid wire 30. When the supply voltage V reverses polarity on the next half cycle such that the supply voltage is positive at node 50 and before the starter 38 recloses, the voltage of capacitor 44 will add to the supply voltage in a voltage multiplier manner. This combined voltage will appear across the gap separating electrode 24 and the wire starting aid 30. The polarity of this voltage is such that the electrode 24 will be positive with respect to the starting aid 30. Without the added voltage of capacitor 44, the voltage available is not sufficient to initiate the cold cathode discharge from starting aid 30. This discharge is necessary in order for the wire 30 to function as a lamp starting aid.

The cold cathode discharge from starting aid 30 to electrode 24 will create a free charge comprised of electrons and positive mercury ions. Present understanding of the starting aid mechanism is that preferential ambipolar diffusion of this charge is accomplished by the presence of the negatively charged wire 30. In the region close to the wire 30, the envelope wall will acquire a positive charge due to the electrostatic attraction force of the wire 30. The dipole field established by this charge is significantly greater than that that could be generated by an external wire or stripe since the dipole separation in the latter case is substantially larger, resulting in a lower field strength.

The effect of this dipole field is that additional ionization occurs close to the envelope wall which in turn extends the dipole field further along the wire 30. This is analagous to the process which takes place between the negatively charged inner envelope wall and the positively charged outer wall with an external lamp starting aid. In this manner a conducting sheath is established along the bulb wall to a point where the axial lamp field is sufficient to start the lamp. In this regard the value of capacitor 44 is critical with regard to a minimum threshold value. This value must be greater than 0.1 $\mu$f; otherwise, a substantial voltage loss will occur during the polarity reversal of the supply voltage V. Laboratory measurements have indicated that this effect is probably caused by a capacitor discharge current resulting from space charge absorption at electrode 24 when the supply voltage polarity reverses and becomes positive at electrode 24.

The wire starting aid 30 described herein is superior to all previous designs. Compared to internal conductive coatings or stripes, the wire starting aid is superior due to the ease of manufacture and the lower cost. Further, it is readily adaptible to non-linear lamps.

In linear or straight line lamps the wire starting aid offers improved performance due to improved optical transmission as well as superior lumen maintenance.

Compared to external starting aids, superior performance is realized because of the increased electric field strength associated with the inner wire. It is also better from a cost and manufacturing standpoint since additional steps would be required in the application of an external starting aid to a finished lamp. From an aesthetic consideration, the present invention offers an additional advantage in that external starting aids require some form of electrical insulation in situations where electrical connection is required at some point in the circuit. The present invention is practically invisible in the finished lamp.

We claim:

1. A fluorescent lamp assembly comprising: a fluorescent lamp having a tubular glass body with electrodes at each end thereof, each electrode being supported by a pair of lead-in wires sealed in glass sealing means; a layer of phosphor on the interior surface of said body and an arc generating and sustaining medium therein; one of said ends being provided with a third lead-in wire adjacent to one of said electrodes; a wire starting aid connected to said third lead-in wire and extending the length of said body to a position adjacent said other electrode; a resistive ballast for said lamp serially coupling said electrodes and a lamp starting means; and means capacitively coupling said third lead-in wire to one of the lead-in wires of its adjacent electrode.

2. The lamp assembly of claim 1 wherein said starting means is a glow-bottle.

3. The lamp of claim 1 wherein said means capacitively coupling said third lead-in wire to said lead-in wire of said adjacent electrode is a capacitor having a value of at least 0.1 $\mu$f.

* * * * *